US006981434B2

(12) United States Patent
Chen

(10) Patent No.: US 6,981,434 B2
(45) Date of Patent: Jan. 3, 2006

(54) REINFORCEMENT STRUCTURE FOR WRENCH HEAD

(76) Inventor: Terence Chen, No. 325, Yungching Rd., Dungshan Shiang, Ilan (TW)

( * ) Notice: Subject to any disclaimer, the term of this patent is extended or adjusted under 35 U.S.C. 154(b) by 0 days.

(21) Appl. No.: 10/854,344

(22) Filed: May 27, 2004

(65) Prior Publication Data

US 2004/0216564 A1 Nov. 4, 2004

Related U.S. Application Data

(63) Continuation-in-part of application No. 10/428,114, filed on May 2, 2003, now Pat. No. 6,857,339.

(51) Int. Cl.
*B25B 13/46* (2006.01)

(52) U.S. Cl. ..... 81/63.1; 81/58; 81/60; 192/43.1

(58) Field of Classification Search ..... 81/58, 81/58.4, 60–62, 63.1; 192/43.1
See application file for complete search history.

(56) References Cited

U.S. PATENT DOCUMENTS 6,457,388 B1 * 10/2002 Chen ..... 81/63.2
6,789,449 B2 * 9/2004 Liu ..... 81/63.2
6,857,339 B2 * 2/2005 Chen ..... 81/63.1

* cited by examiner

*Primary Examiner*—David B. Thomas
(74) *Attorney, Agent, or Firm*—Rosenberg, Klein & Lee

(57) ABSTRACT

A wrench includes a head with an engaging wheel rotatably received in a through hole in the head and a recess is defined in an inner periphery of the through hole so as to receive two pawls therein. A recessed area is defined in a surface of the head and a bridge portion is located between the through hole and the recessed area. A space is defined in an underside of the bridge portion and in communication with the through hole. Each pawl has a protrusion and the space allows the protrusions of the pawl to be inserted in the recess without any orientation adjustment. A control member is rotatably received in the recessed area and has a concavity for retaining the two protrusions therein.

4 Claims, 8 Drawing Sheets

REINFORCEMENT STRUCTURE FOR WRENCH HEAD

FIELD OF THE INVENTION

This is a Continuation-In-Part application of applicant's former patent application Ser. No. 10/428,114, filed on May 2, 2003, now U.S. Pat. No. 6,857,339.

BACKGROUND OF THE INVENTION

Applicant's former U.S. Pat. No. 6,691,594 discloses a wrench wherein the pawls each have a protrusion on a top thereof and when installing the pawls into the recess defined in communication with the through hole in the head, the pawls have to be tilted such that the protrusions can be inserted in the recess first and then the two respective bodies of the pawls are rotated to be inserted in the recess. This spends too much assembly time. Some manufacturers break the portion between the through hole for receiving the engaging wheel and the recessed area for receiving the control member, such that the pawls can be inserted in the recess for the pawls directly without any angle adjustment. Nevertheless, the broken space weakens the structural strength of the head of the wrench.

U.S. Pat. Nos. 6,575,060 and 6,279,428 respectively disclose a wrench wherein the pawl includes a curve surface and the control member drives the center of the curve surface directly. As shown in FIG. 9 which discloses the structure of U.S. Pat. Nos. 6,282,991 and 6,282,992. The head 91 of the wrench 90 has a first hole 910 for receiving an engaging wheel 94 therein and a second hole 95 is defined between and in communication with the first hole 910 and a third hole 93 which receives a control member 92 therein. A pawl 96 is received in the second hole 95 and is engaged with the engaging wheel 94. a driving piece 97 has one end received int eh control member 92 and the other end of the driving piece 97 is engaged with a recess defined in the pawl 96. The pawl 96 is shifted left and right so that the distal end of the second hole 95 is in a broken state with the third hole 93, and the curve inside of the second hole 93 supports the pawl 96. The curve inside cannot provide sufficient support to the pawl 96.

The present invention intends to provide a wrench wherein a yield space is defined in an underside of the bridge portion located between the through hole for receiving the engaging wheel in the head and a recessed area for receiving the control member such that the protrusions of the pawls can be installed directly without any adjustment and the structural strength of the head of the wrench is reinforced.

SUMMARY OF THE INVENTION

The present invention relates to a wrench which comprises a head having a through hole for receiving an engaging wheel and a recess for receiving two pawls is defined in an inner periphery of the through hole. A recessed area is defined in a surface of the head and a bridge portion is located between the through hole and the recessed area. A space is defined in an underside of the bridge portion and in communication with the through hole. A spring is connected between the two pawls and each pawl has a protrusion which extends into the recessed area. A control member is rotatably received in the recessed area and has a concavity in which the two protrusions are retained.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
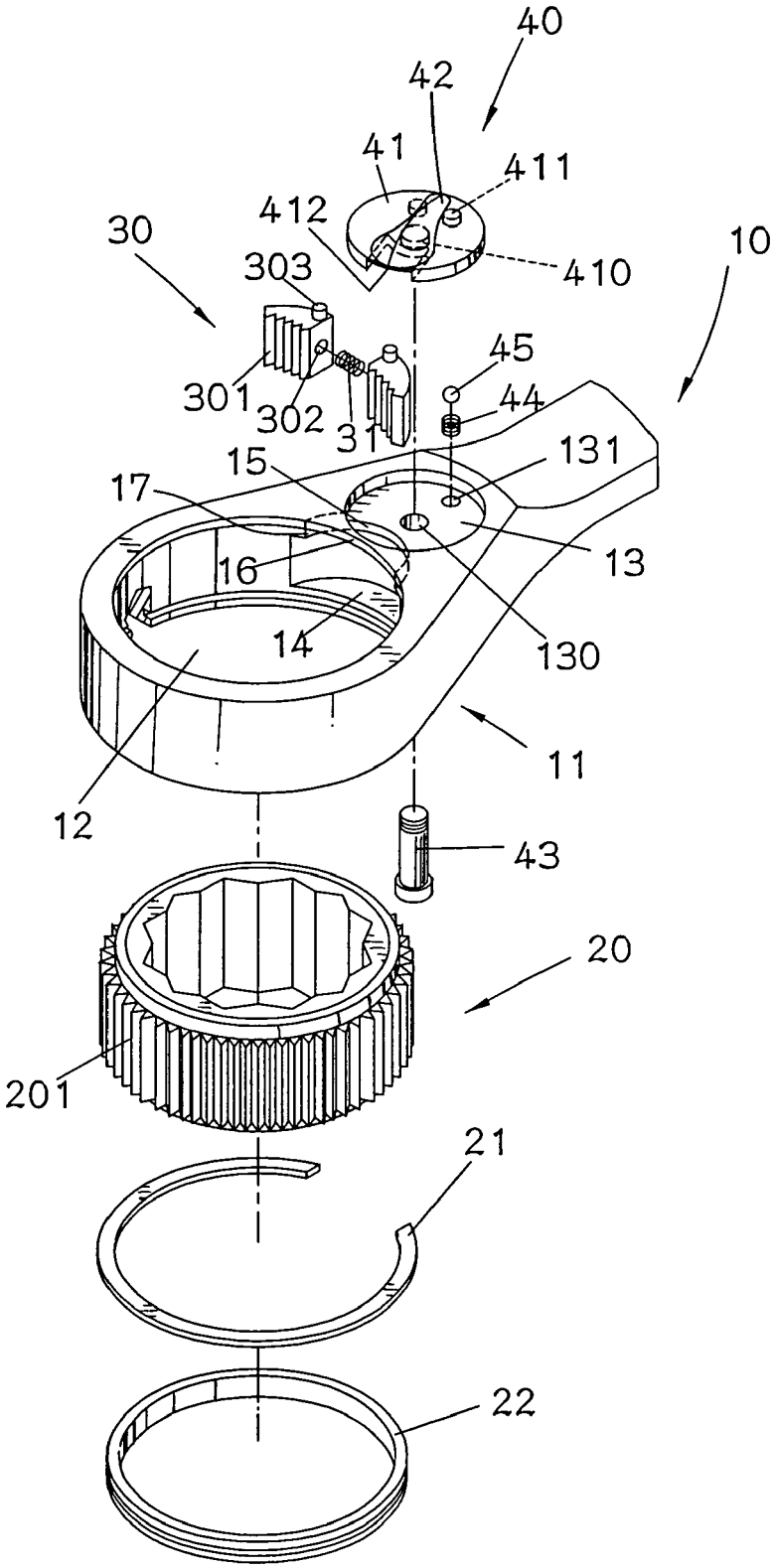
FIG. 1 is an exploded view to show the wrench of the present invention.
Figure 2:
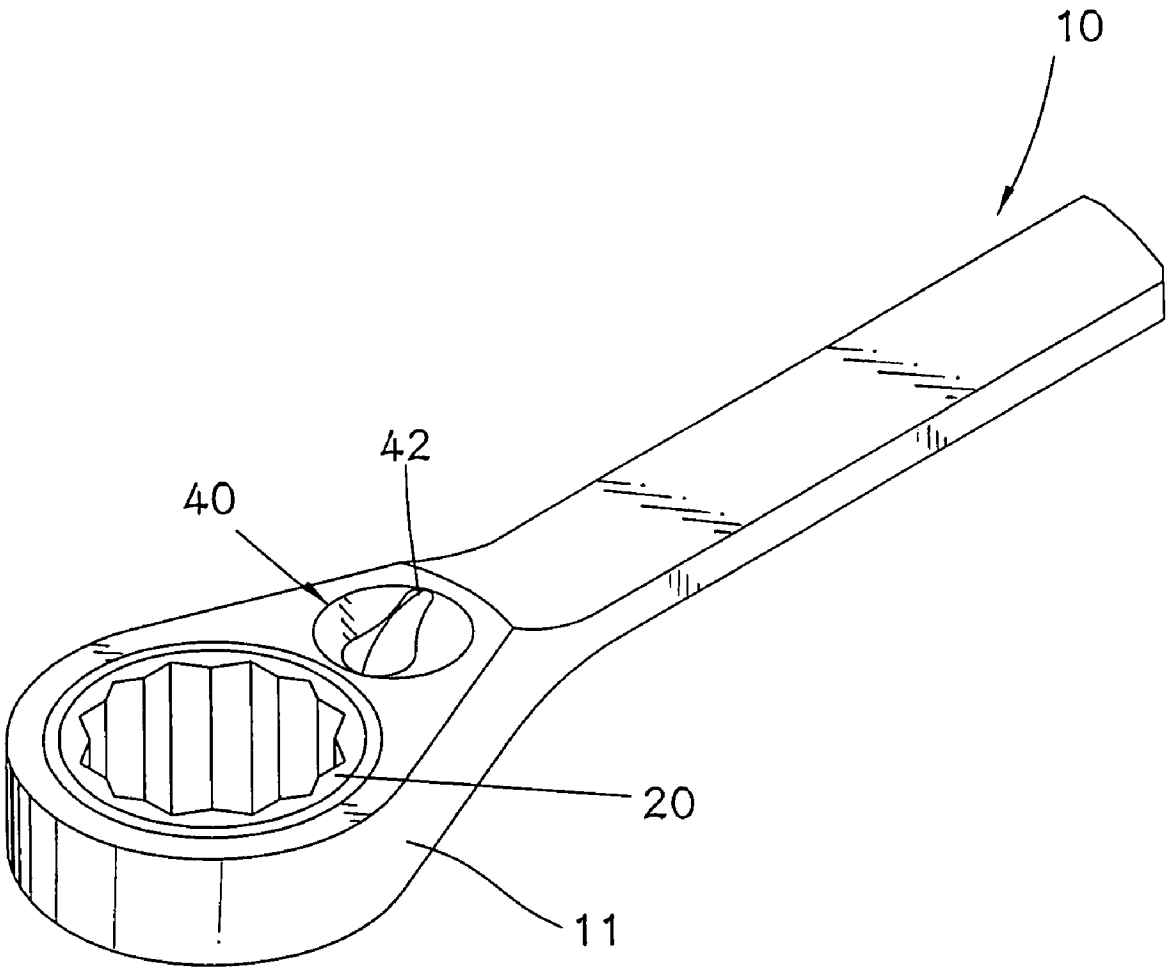
FIG. 2 is a perspective view to show the wrench of the present invention.
Figure 3:
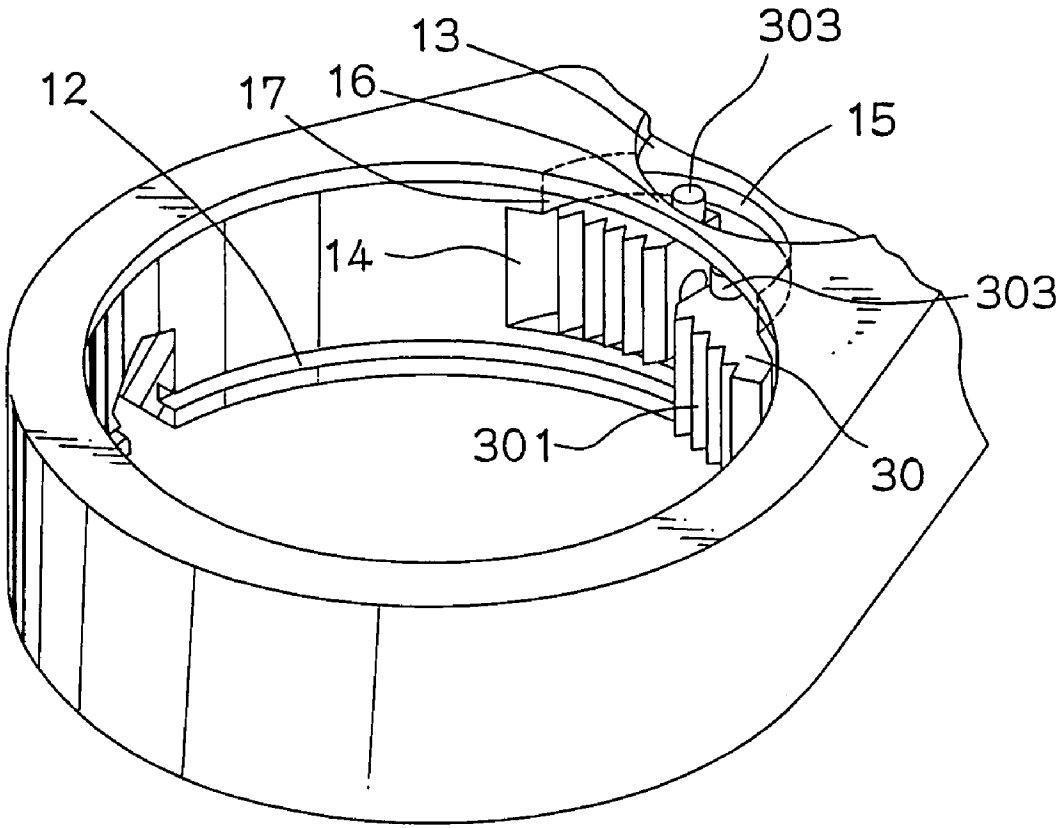
FIG. 3 is a perspective view to show the two pawls received in the recess.
Figure 4:
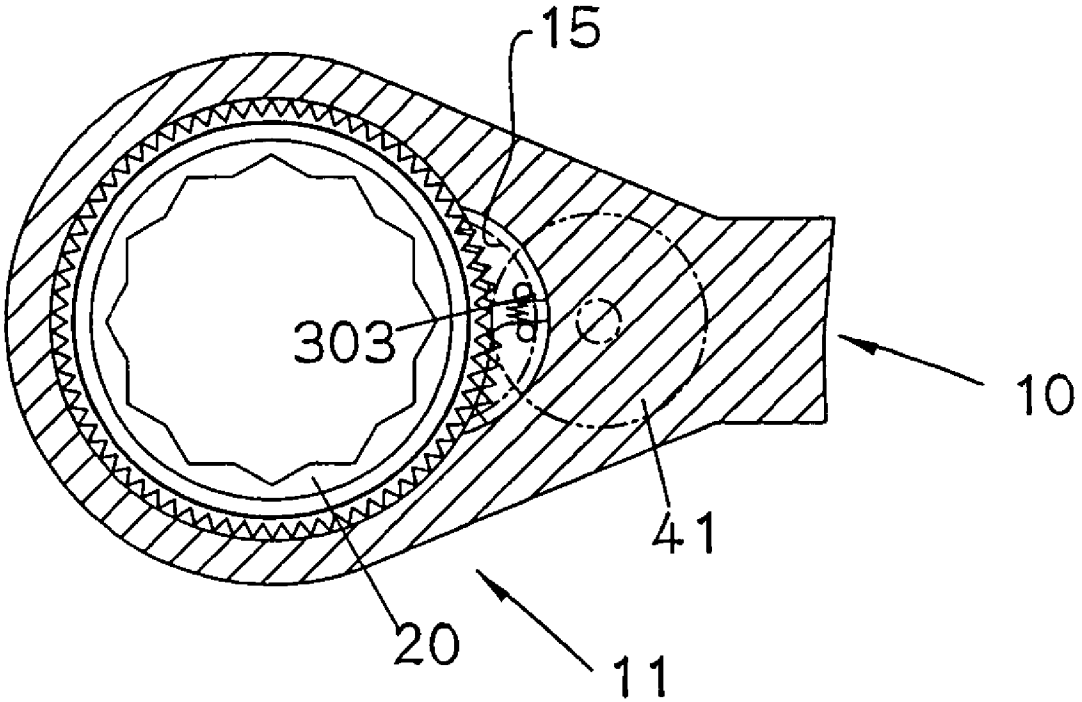
FIG. 4 is a top cross sectional view to show the wrench of the present invention.
Figure 5:
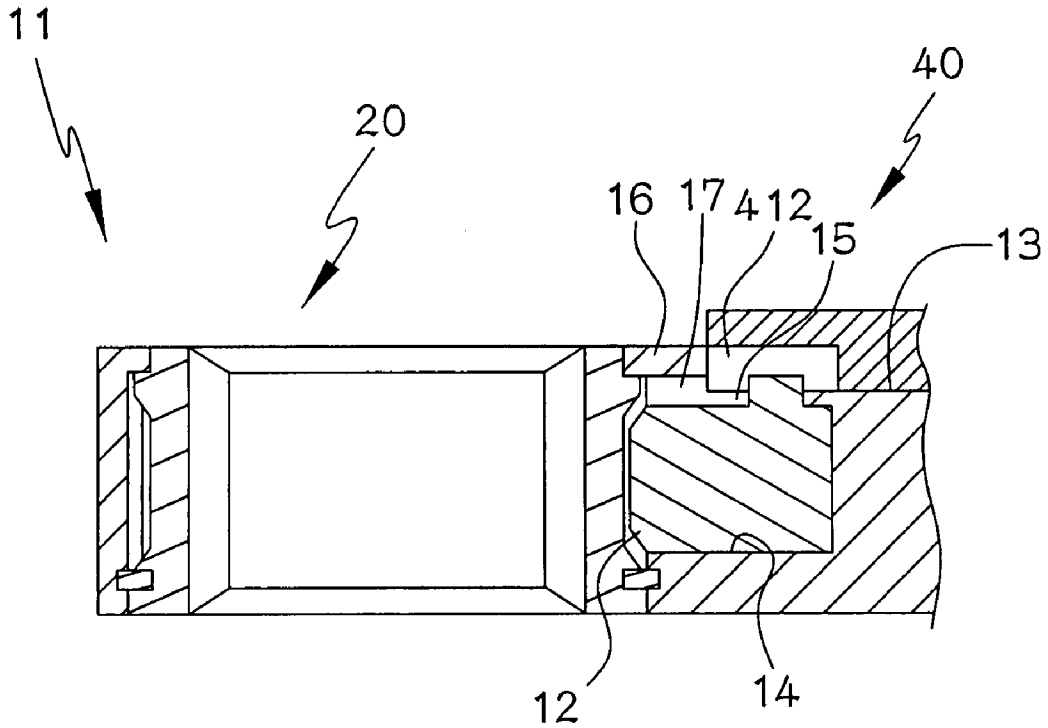
FIG. 5 is a side cross sectional view to show the wrench of the present invention.

Referring to FIGS. 1 to 5, the wrench 10 of the present invention comprises a head 11 having a through hole 12 defined therethrough and a recess 14 is defined in an inner periphery of the through hole 12. An engaging wheel 20 with outer teethed surface 201 is rotatably received in the through hole 12 and positioned by a C-clip 21 cooperated with a ring 22.

A recessed area 13 is defined in a surface of the head 11 and a bridge portion 16 is located between the through hole 12 and the recessed area 13. The bridge portion 16 is made to be thinner so as to have a space 17 defined in an underside of the bridge portion 16 and in communication with the through hole 12 and the recess 14. A central hole 130 is defined through the recessed area 13. Two pawls 30 are movably received in the recess 14 and a spring 31 is connected between two respective holes 302 defined in two facing ends of the two pawls 30. The two pawls 30 each have a protrusion 303 on a top thereof and the two protrusions 303 extend into the recessed area 13 via an opening 15 that is a part of the space 17 and defined through the recessed area 13. The two pawls 30 have a toothed side 301 which is alternatively engaged with the outer teethed surface 201 of the engaging wheel 20.

Figure 7:
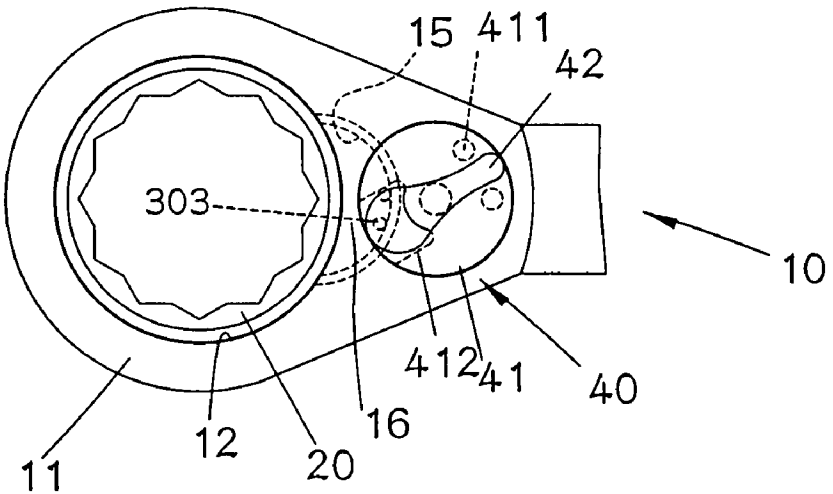
FIGS. 6 and 7 show two positions of the pawls controlled by the control member.
Figure 6:
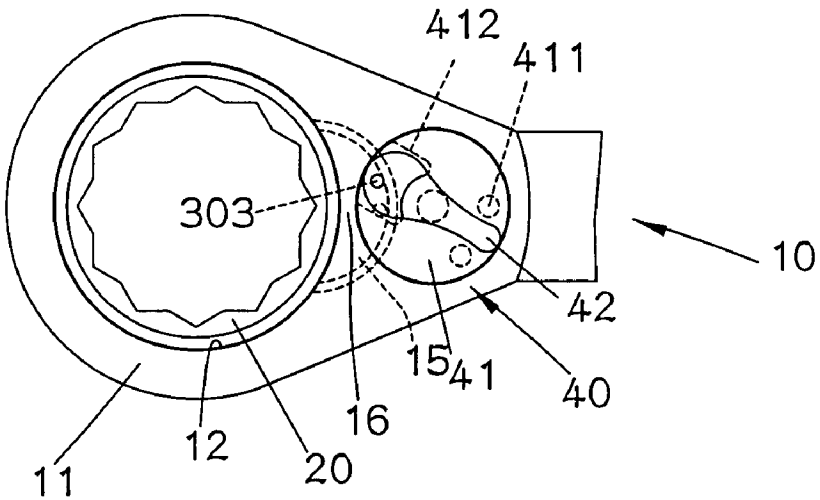

Further referring to FIGS. 6 and 7, a control member 40 rotatably received in the recessed area 13 and includes a disk 41 which has a positioning hole 410 so that a bolt 43 extends through the central hole 130 and the positioning hole 410. A recess 131 is defined in a top of the inside of the recessed area 13 and a bead 45 and a spring 44 are received in the recess 131. The bead 45 is engaged with one of two dents 411 defined in an underside of the disk 41 so that the user can position the disk 40 at two positions defined by the two dents 411. A concavity 412 is defined in a periphery thereof so as to retain the two protrusions 303 so that when the user shifts a lever 42 on the disk 41, the two pawls 30 are moved in the recess 14 and engaged with the engaging wheel 20.

Because of the space 17, when installing the pawls 30 into the recess 14, the pawls 30 need not to tilt and the protrusions 303 are allowed to pass through the space 17 and the pawls 30 are conveniently installed in the recess 14.

Figure 8:
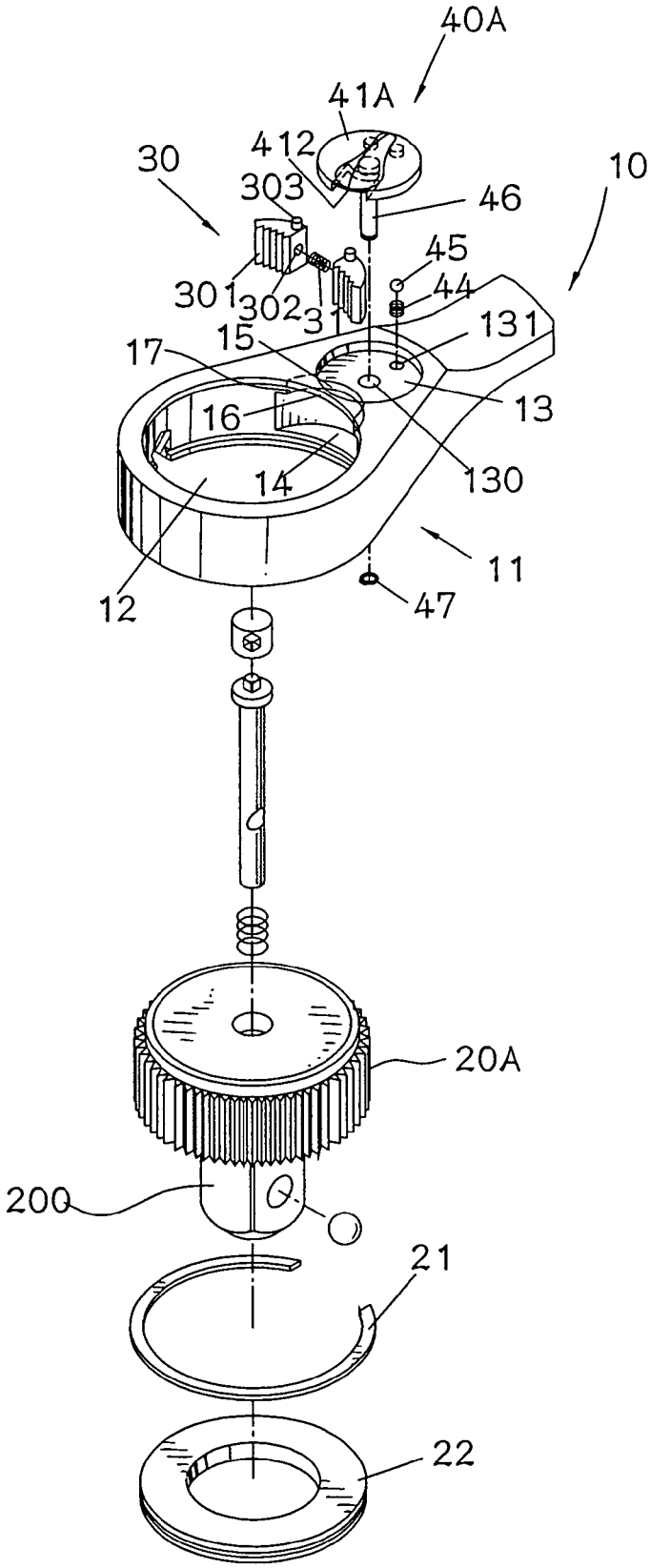
FIG. 8 is an exploded view to show another embodiment of the wrench of the present invention.
Figure 9:
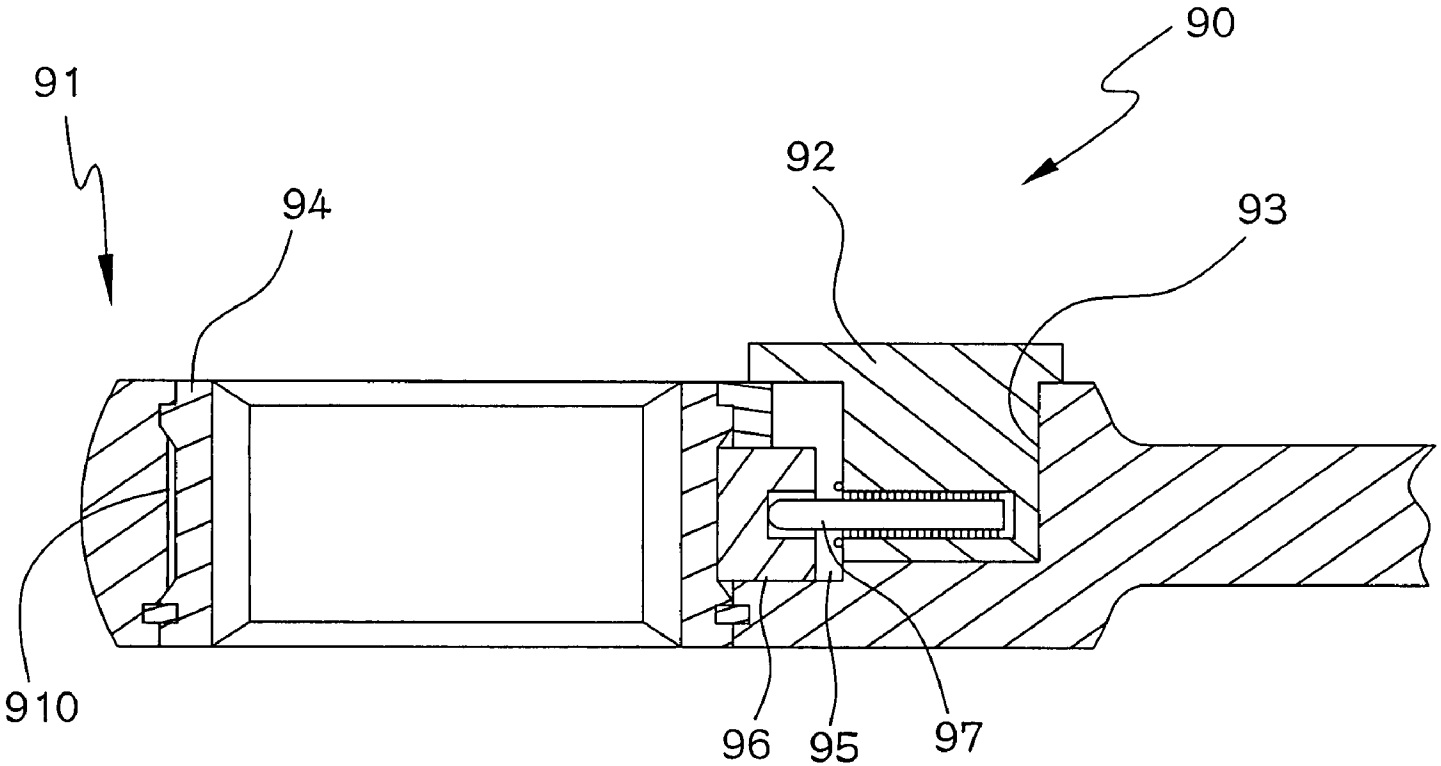
FIG. 9 PRIOR ART
FIG. 9 is a side cross sectional view to show a conventional wrench.

As shown in FIG. 8, the invention can also used in a ratchet wrench that has a driving shaft 200 integrally extending from the engaging wheel 20A. The difference from the embodiment as disclosed in FIGS. 1–5 is that the control member 40A includes a rod 46 extending from an underside of the disk 41A and a retaining member 47 is mounted to the rod 46 after the rod 46 extends through the central hole 130 in the recessed area 13 so as to position the control member 40A.

While we have shown and described the embodiment in accordance with the present invention, it should be clear to those skilled in the art that further embodiments may be made without departing from the scope of the present invention.

What is claimed is:

1. A wrench (10) comprising:

a head (11) having a through hole (12) defined therethrough and a recess (14) defined in an inner periphery of the through hole (12), a recessed area (13) defined in a surface of the head (11) and a bridge portion (16) located between the through hole (12) and the recessed area (13), a space (17) defined in an underside of the bridge portion (16) and in communication with the through hole (12);

an engaging wheel (20) rotatably received in the through hole (12);

two pawls (30) and a spring (31) connected between the two pawls (30), the two pawls (30) movably received in the recess (14), each pawl (30) having a protrusion (303) which extends into the recessed area (13), and a control member (40) rotatably received in the recessed area (13) and having a concavity (412) in which the two protrusions (303) are retained, the two pawls (30) being moved when the control member (40) is rotated.

2. The wrench as claimed in claim 1, wherein a central hole (130) is defined through the recessed area (13) and the control member (40) includes a positioning hole (410), a bolt (43) extending through the central hole (130) and the positioning hole (410).

3. The wrench as claimed in claim 1, wherein a central hole (130) is defined through the recessed area (13) and the control member (40A) includes a rod (46) extends from an underside thereof, a retaining member (47) mounted to the rod (46) so as to position the control member (40A).

4. A wrench comprising:

a head (11) having a through hole (12) defined therethrough and a recess (14) defined in an inner periphery of the through hole (12), a recessed area (13) defined in a surface of the head (11) and a bridge portion (16) located between the through hole (12) and the recessed area (13), a space (17) defined in an underside of the bridge portion (16) and in communication with the through hole (12), the space (17) allowing protrusions (303) on pawls (30) to be inserted in the recess (14) directly.

* * * * *